US008844249B2

(12) United States Patent
Ushidate et al.

(10) Patent No.: US 8,844,249 B2
(45) Date of Patent: Sep. 30, 2014

(54) FILM SUPPLYING APPARATUS

(75) Inventors: Toshiyuki Ushidate, Habikino (JP); Seiichi Matsushita, Yamatotakada (JP)

(73) Assignee: Fuji Seal International, Inc., Osaka (JP)

( * ) Notice: Subject to any disclaimer, the term of this patent is extended or adjusted under 35 U.S.C. 154(b) by 544 days.

(21) Appl. No.: 13/255,333

(22) PCT Filed: Feb. 24, 2010

(86) PCT No.: PCT/JP2010/052825
§ 371 (c)(1),
(2), (4) Date: Sep. 27, 2011

(87) PCT Pub. No.: WO2010/110004
PCT Pub. Date: Sep. 30, 2010

(65) Prior Publication Data

US 2012/0016513 A1 Jan. 19, 2012

(30) Foreign Application Priority Data

Mar. 27, 2009 (JP) ..... 2009-078332

(51) Int. Cl.
*B65B 9/00* (2006.01)
*B65C 9/18* (2006.01)
*B65H 5/22* (2006.01)
*B65C 3/06* (2006.01)

(52) U.S. Cl.
CPC ..... *B65C 3/065* (2013.01); *B65H 5/224* (2013.01); *B65H 2801/75* (2013.01)
USPC ..... 53/451; 156/541; 156/DIG. 33; 700/122

(58) Field of Classification Search
CPC ..... B65B 9/00; B65B 9/213; B65B 9/22; B65B 9/2028; B65C 3/065; B65C 9/08; B65C 9/18; B65C 9/183; B65C 9/1815; B65C 9/1884; B65C 11/00; B65C 1/004; B65H 5/224
USPC ..... 700/122, 170, 275, 279; 53/228, 234, 53/410, 415, 556; 156/249, 541, DIG. 24, 156/DIG. 28, DIG. 33, DIG. 37, DIG. 39, 156/DIG. 45
See application file for complete search history.

(56) References Cited

U.S. PATENT DOCUMENTS 5,855,106 A * 1/1999 Koyama et al. ..... 53/556
6,382,515 B1 * 5/2002 Good et al. ..... 235/472.01

(Continued)

FOREIGN PATENT DOCUMENTS

JP A-8-119234 5/1996
JP A-2003-34452 2/2003

(Continued)

OTHER PUBLICATIONS

International Search Report mailed Jun. 1, 2010 issued in International Patent Application No. PCT/JP2010/052825 (with translation).

(Continued)

*Primary Examiner* — Charles Kasenge
(74) *Attorney, Agent, or Firm* — Oliff PLC

(57) ABSTRACT

A film supplying apparatus includes: an upstream belt conveying unit and a downstream belt conveying unit that sequentially convey a label formed by cutting a label-forming base material, to a label delivery position; a label detection sensor that detects the label at an upper position of the downstream belt conveying unit; an encoder attached to a take-up spindle of a label delivery apparatus; and a control unit that calculates the amount of shift in the label on the basis of a label detection signal from the label detection sensor and a pulse signal from the encoder, and controls the operation of the downstream belt conveying unit conveying the label, so as to convey the label and stop the label at the label delivery position, while modifying the amount of shift.

4 Claims, 10 Drawing Sheets

(56) References Cited

U.S. PATENT DOCUMENTS

| | | | | |
|---|---|---|---|---|
| 6,457,642 | B1 * | 10/2002 | Good et al. | 235/462.01 |
| 6,554,189 | B1 * | 4/2003 | Good et al. | 235/462.01 |
| 8,621,745 | B2 * | 1/2014 | Deonarine et al. | 29/775 |
| 2002/0014055 | A1 * | 2/2002 | Iwasa et al. | 53/551 |
| 2003/0093971 | A1 * | 5/2003 | Terminella et al. | 53/133.4 |
| 2005/0029733 | A1 | 2/2005 | Hagemann et al. | |
| 2005/0235613 | A1 * | 10/2005 | Malini | 53/556 |
| 2006/0048485 | A1 * | 3/2006 | Iwasa et al. | 53/451 |
| 2007/0113965 | A1 * | 5/2007 | Harte | 156/249 |
| 2007/0113986 | A1 * | 5/2007 | Harte | 156/541 |

FOREIGN PATENT DOCUMENTS

| | | |
|---|---|---|
| JP | A-2007-1593 | 1/2007 |
| JP | A-2007-8522 | 1/2007 |
| JP | A-2007-176527 | 7/2007 |

OTHER PUBLICATIONS

International Preliminary Report on Patentability issued Nov. 15, 2011 in International Patent Application No. PCT/JP2010/052825 (with translation).

* cited by examiner

FILM SUPPLYING APPARATUS

TECHNICAL FIELD

The present invention relates to a film supplying apparatus mounted to, for example, a film placement system for placing a tubular film, such as a stretch label and a shrink label, around a placement target, such as a jar and a bottle.

BACKGROUND ART

For example, to a label placement system for placing a tubular label, such as a stretch label and a shrink label, around the outer periphery of the body of a jar or a bottle, a label supplying apparatus is mounted that forms a label having a predetermined length by sequentially cutting a long strip-like label-forming base material formed of continuously connected sheet-like folded tubular labels, and that sequentially supplies the label. The label having the predetermined length supplied by the label supplying apparatus is delivered to a label placement apparatus via a label delivery apparatus.

As shown in FIGS. 9(*a*) and (*b*), the label supplying apparatus includes: sending rollers 101 that deliver a sheet-like folded, long strip-like label-forming base material M; a cutting unit 102 that forms an individual label L by cutting the label-forming base material M delivered by the sending rollers 101 to a predetermined length; and a belt conveying unit 103 that conveys the label L cut to the predetermined length to a first label delivery position α. The belt conveying unit 103 conveys the label L cut to the predetermined length to the first label delivery position α, with the label L held by suction by a pair of feed belts 103*a*, 103*a* provided parallel to each other at a predetermined distance.

Meanwhile, as shown in FIGS. 9(*a*) and (*b*), the label delivery apparatus includes a plurality of take-up members 111 that rotate at a constant rotational speed so as to pass through the first label delivery position α and a second label delivery position β. The label delivery apparatus receives the label L supplied to the first label delivery position α so as to be sheet-like folded, as a result of, as shown in FIG. 10, a holding section 112 of each take-up member 111 hooking and holding by suction the label L, the holding section 112 passing between the pair of feed belts 103*a*, 103*a*, and subsequently conveys the label L to the second label delivery position β in this state. Then, the label delivery apparatus receives the label L at the second label delivery position β as a result of a swinging arm 122 of a label opener 121 of the label placement apparatus gripping the label L.

CITATION LIST

Patent Literature

[PTL 1] Japanese Laid-Open Patent Publication No. 2007-176527

SUMMARY OF THE INVENTION

Problems to be Solved by the Invention

Incidentally, in the label supplying apparatus as described above, the belt conveying unit 103 merely conveys the label L in synchronization with the label delivery apparatus so that the label L is supplied to the label delivery position α in accordance with the timing of the take-up member 111 of the label delivery apparatus passing through the label delivery position α. Accordingly, for example, when the individual label L formed as a result of the cutting unit 102 cutting the label-forming base material M has failed to transfer smoothly to the feed belts 103*a* of the belt conveying unit 103, and the timing of the label L transferring to the feed belts 103*a* has become somewhat late, or when the label L is held by suction by the feed belts 103*a* downstream of a predetermined position for some reasons, a shift will occur in the position of the label L in the vertical direction when the take-up member 111 passes through the label delivery position α. Thus, the take-up member 111 cannot receive the label L in an appropriate manner, and the label L will be delivered to the label opener 121 of the label placement apparatus while shifted in position. This may interfere with the handling of the label L in the label placement apparatus.

Further, the take-up members 111 of the label delivery apparatus are preferably attached to a rotating base such that the orientations of all the take-up members 111 are the same. However, when the take-up members 111 are attached to the rotating base such that each take-up member 111 has shifted in position in the rotational direction due to a low attachment accuracy of the take-up member 111, the timing of the take-up member 111 passing through the label delivery position α will shift. Accordingly, even when the label L is supplied to the label delivery position α at appropriate timing, the take-up member 111 cannot receive the label L in an appropriate manner. This causes a problem similar to the case where the timing of the belt conveying unit 103 supplying the label L has shifted as described above.

Therefore, it is an object of the present invention to improve a film supplying apparatus for supplying a film to a predetermined film delivery position in accordance with timing of a film delivery member receiving the film, the film delivery member receiving the film when passing through the film delivery position and delivering the film to a film processing apparatus, so that even when the film has shifted in position while conveyed, or even when the film delivery member has a somewhat low attachment accuracy, the film delivery member can receive the film in an appropriate manner.

Solution to the Problems

To achieve the above object, the invention of claim 1 provides a film supplying apparatus for supplying a film to a predetermined film delivery position in accordance with timing of a film delivery member receiving the film, the film delivery member receiving the film when passing through the film delivery position and delivering the film to a film processing apparatus, the film supplying apparatus including: an upstream belt conveying unit for conveying the film with a feed belt holding the film by suction, the upstream belt conveying unit driven by a servomotor; a downstream belt conveying unit for conveying the film that has been conveyed by the upstream belt conveying unit, to the film delivery position with feed belts holding the film by suction, the downstream belt conveying unit driven by a servomotor; film detection means for detecting the film that is being conveyed at a predetermined reference position; and a control unit for controlling operations of the upstream belt conveying unit and the downstream belt conveying unit, wherein a target amount of movement of the feed belt of the upstream belt conveying unit and a target amount of movement of the feed belts of the downstream belt conveying unit are set in advance in accordance with a position of the film delivery member, so that the film stops at, or enters at a low speed, the film delivery position when the film delivery member passes through the film delivery position, the control unit controls positioning of the servomotor so as to obtain the target amount of movement of the feed belt of the upstream belt conveying unit set in advance, and also controls positioning of the servomotor so as to obtain the target amount of movement of the feed belts of the downstream belt conveying unit set in advance, and if an actual amount of movement of the feed belts when the film detection means has detected the film is different from the target amount of movement of the feed belts, it is determined that a shift has occurred in a position where the feed belts hold the film by suction, and the target amount of movement of the feed belts of the downstream belt conveying unit after the film has completely transferred to the feed belts of the downstream belt conveying unit is corrected on the basis of an amount of shift between the actual amount of movement of the feed belts and the target amount of movement thereof, so that the film is conveyed while a shift in timing of supplying the film caused by a shift in the film is modified.

Further, to achieve the above object, the invention of claim 2 provides a film supplying apparatus for supplying a film to a predetermined film delivery position in accordance with timing of a film delivery member receiving the film, the film delivery member receiving the film when passing through the film delivery position and delivering the film to a film processing apparatus, the film supplying apparatus including: an upstream belt conveying unit for conveying the film with a feed belt holding the film by suction, the upstream belt conveying unit driven by a servomotor; a downstream belt conveying unit for conveying the film that has been conveyed by the upstream belt conveying unit, to the film delivery position with feed belts holding the film by suction, the downstream belt conveying unit driven by a servomotor; film detection means for detecting the film that is being conveyed at a predetermined reference position; delivery member detection means for detecting the film delivery member at a predetermined reference position; and a control unit for controlling operations of the upstream belt conveying unit and the downstream belt conveying unit, wherein a target amount of movement of the feed belt of the upstream belt conveying unit and a target amount of movement of the feed belts of the downstream belt conveying unit are set in advance in accordance with a position of the film delivery member, so that the film is placed at the film delivery position when the film delivery member passes through the film delivery position, the control unit controls positioning of the servomotor so as to obtain the target amount of movement of the feed belt of the upstream belt conveying unit set in advance, and also controls positioning of the servomotor so as to obtain the target amount of movement of the feed belts of the downstream belt conveying unit set in advance, if an actual amount of movement of the feed belts when the film detection means has detected the film is different from the target amount of movement of the feed belts, it is determined that a shift has occurred in a position where the feed belts hold the film by suction, and if timing of the delivery member detection means detecting the film delivery member is shifted from original appropriate timing, it is determined that a shift will occur in the timing of the film delivery member receiving the film, and the target amount of movement of the feed belts of the downstream belt conveying unit after the film has completely transferred to the feed belts of the downstream belt conveying unit is corrected on the basis of an amount of shift between the actual amount of movement of the feed belts and the target amount of movement thereof and an amount of shift between the timing of detecting the film delivery member and the appropriate timing, so that the film is conveyed while a shift in timing of supplying the film caused by a shift in the film is modified, taking into account the shift in the timing of the film delivery member receiving the film.

Advantageous Effects of the Invention

As described above, in the film supplying apparatus according to the invention of claim 1, if an actual amount of movement of the feed belts when the film detection means has detected the film is different from the target amount of movement of the feed belts, it is determined that a shift has occurred in a position where the feed belts hold the film by suction, and the target amount of movement of the feed belts of the downstream belt conveying unit after the film has completely transferred to the feed belts of the downstream belt conveying unit is corrected on the basis of an amount of shift between the actual amount of movement of the feed belts and the target amount of movement thereof, so that the film is conveyed while a shift in timing of supplying the film caused by a shift in the film is modified. Thus, even when a shift has occurred in the position where the feed belts hold the film by suction, it is possible to supply the film to the film delivery position in accordance with the timing of the film delivery member receiving the film. In addition, the film is stopped at the film delivery position, or the film is caused to enter the film delivery position at a low speed. Thus, even when the timing of the film delivery member receiving the film has shifted somewhat due to a low attachment accuracy of the film delivery member, it is possible to ignore the effect of the shift. This enables the film delivery member to receive the film in an appropriate manner.

Further, in the film supplying apparatus according to the invention of claim 2, if an actual amount of movement of the feed belts when the film detection means has detected the film is different from the target amount of movement of the feed belts, it is determined that a shift has occurred in a position where the feed belts hold the film by suction, and if timing of the delivery member detection means detecting the film delivery member is shifted from original appropriate timing, it is determined that a shift will occur in the timing of the film delivery member receiving the film, and the target amount of movement of the feed belts of the downstream belt conveying unit after the film has completely transferred to the feed belts of the downstream belt conveying unit is corrected on the basis of an amount of shift between the actual amount of movement of the feed belts and the target amount of movement thereof and an amount of shift between the timing of detecting the film delivery member and the appropriate timing, so that the film is conveyed while a shift in timing of supplying the film caused by a shift in the film is modified, taking into account the shift in the timing of the film delivery member receiving the film. Thus, even when a shift has occurred in the position where the feed belts hold the film by suction, or even when the timing of the film delivery member receiving the film has shifted somewhat due to a low attachment accuracy of the film delivery member, it is possible to supply the film to the film delivery position in accordance with the actual timing of the film delivery member receiving the film. This enables the film delivery member to receive the film in an appropriate manner.

BRIEF DESCRIPTION OF THE DRAWINGS

FIG. 9(*b*) is a partial side view of the label supplying apparatus.

DESCRIPTION OF EMBODIMENTS

Figure 1:
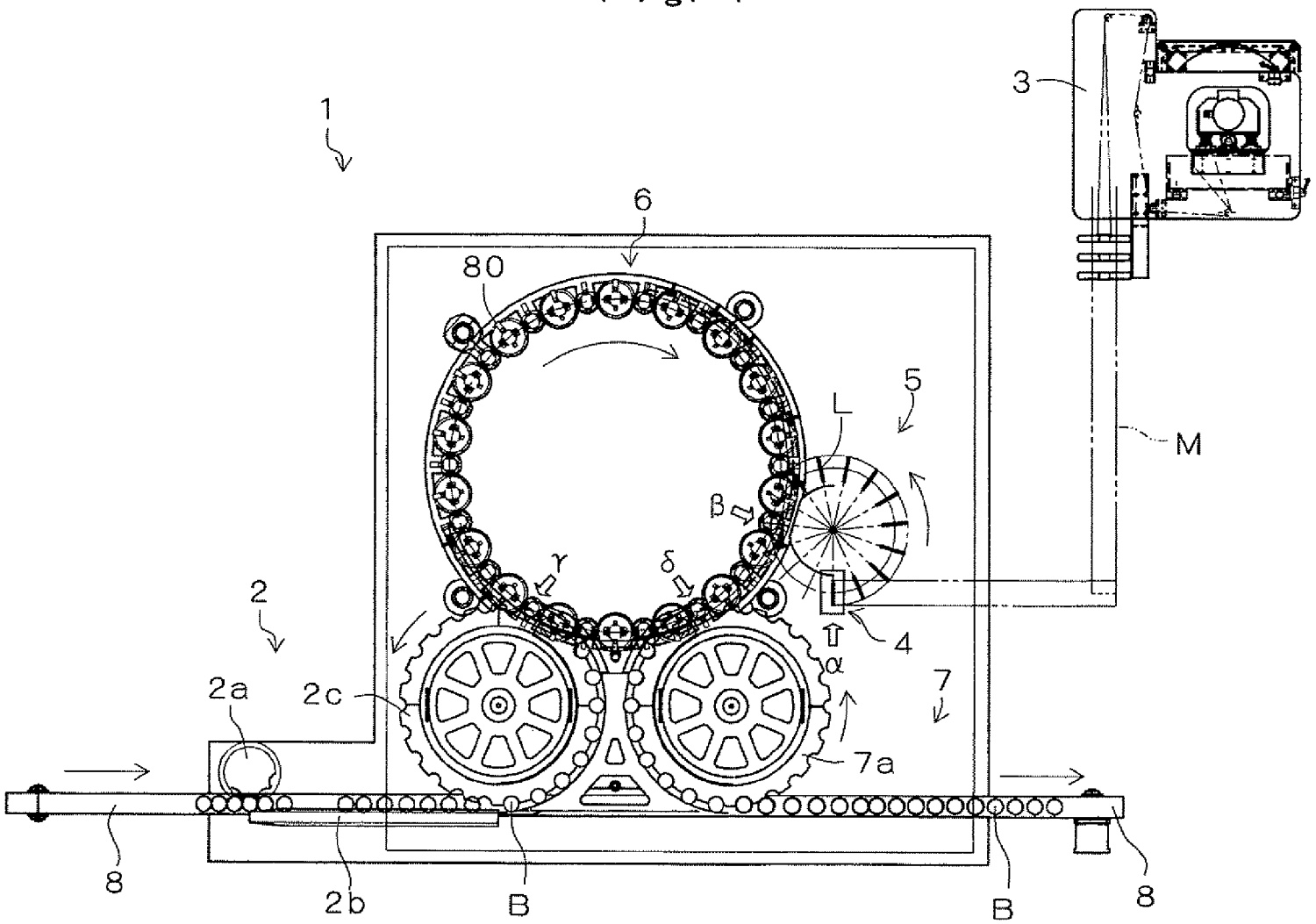
FIG. 1 is a schematic plan view of a label placement system, to which a label supplying apparatus is mounted that corresponds to an embodiment of a film supplying apparatus according to the present invention.

With reference to the drawings, embodiments are described below. FIG. 1 shows a label placement system 1, to which a label supplying apparatus is mounted that corresponds to a film supplying apparatus according to the present invention. As shown in FIG. 1, the label placement system 1 places a tubular shrink label (hereinafter referred to as "label") L around a PET bottle (hereinafter referred to as "bottle") B, the label formed of a heat-shrinkable film of, for example, a polyester resin or a polystyrene resin. As shown in FIG. 1, the label placement system 1 includes: a bottle supplying apparatus 2 having a belt conveyor 8, a star wheel 2*a*, a screw conveyor 2*b*, and a star wheel 2*c*; a label supplying apparatus 4 that forms the label L by sequentially cutting a long label-forming base material M fed from a base material roll by a base material feed apparatus 3, and sequentially supplies the label L to a first label delivery position α; a label delivery apparatus 5 that receives the label L supplied by the label supplying apparatus 4 to the first label delivery position α and conveys the label L to a second label delivery position β; a rotary label placement apparatus 6 that receives the bottle B supplied by the bottle supplying apparatus 2 at a bottle supply position γ and conveys the bottle B to a bottle sending position δ, and that also receives the label L conveyed by the label delivery apparatus 5 at the second label delivery position β and places the label L around the bottle B while conveying the bottle B from the bottle supply position γ to the bottle sending position δ; and a bottle conveying apparatus 7 that has a star wheel 7*a* and a belt conveyor 8 and discharges the bottle B around which the label L has been placed by the label placement apparatus 6.

Figure 2:
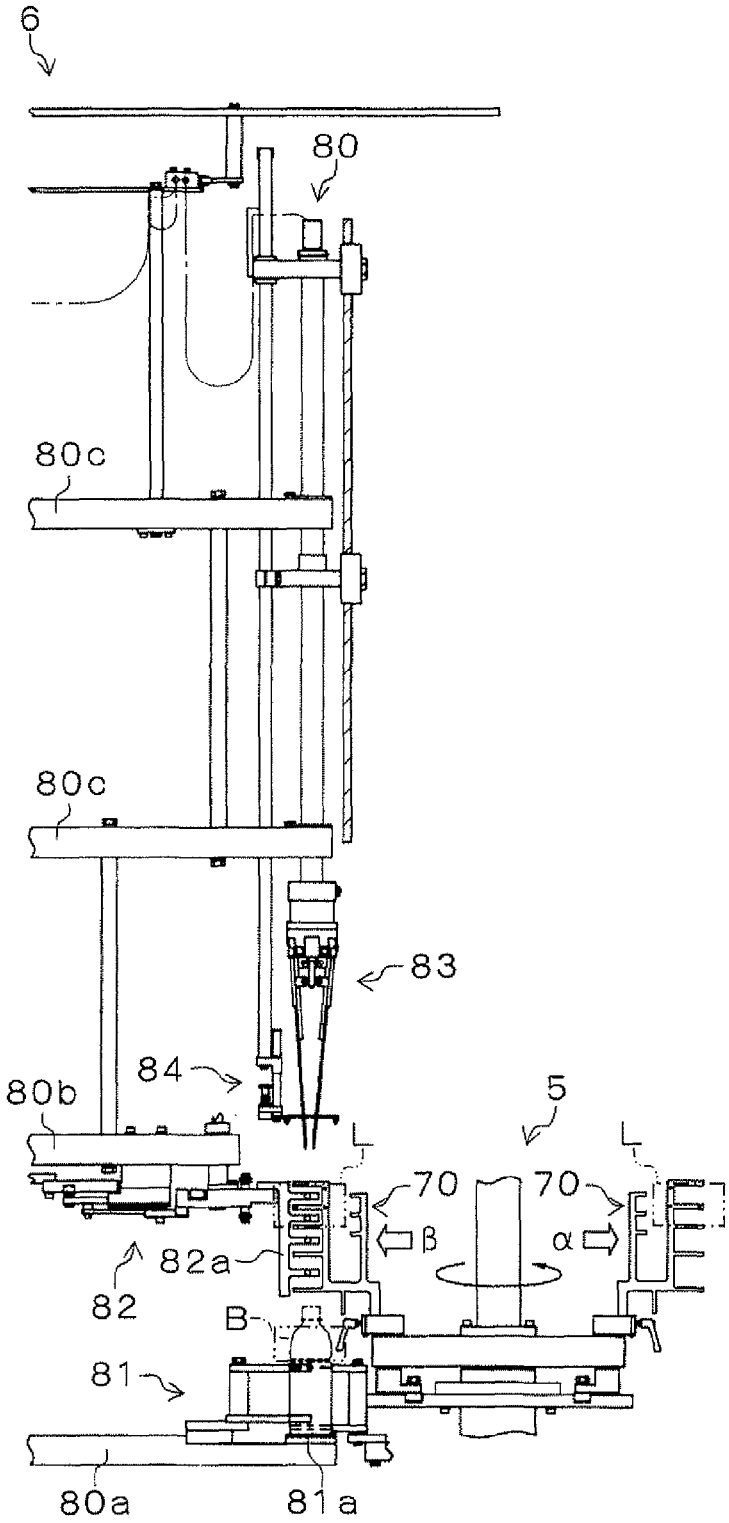
FIG. 2 is a schematic diagram showing a label placement apparatus (label placement head) mounted to the label placement system.
Figure 3:
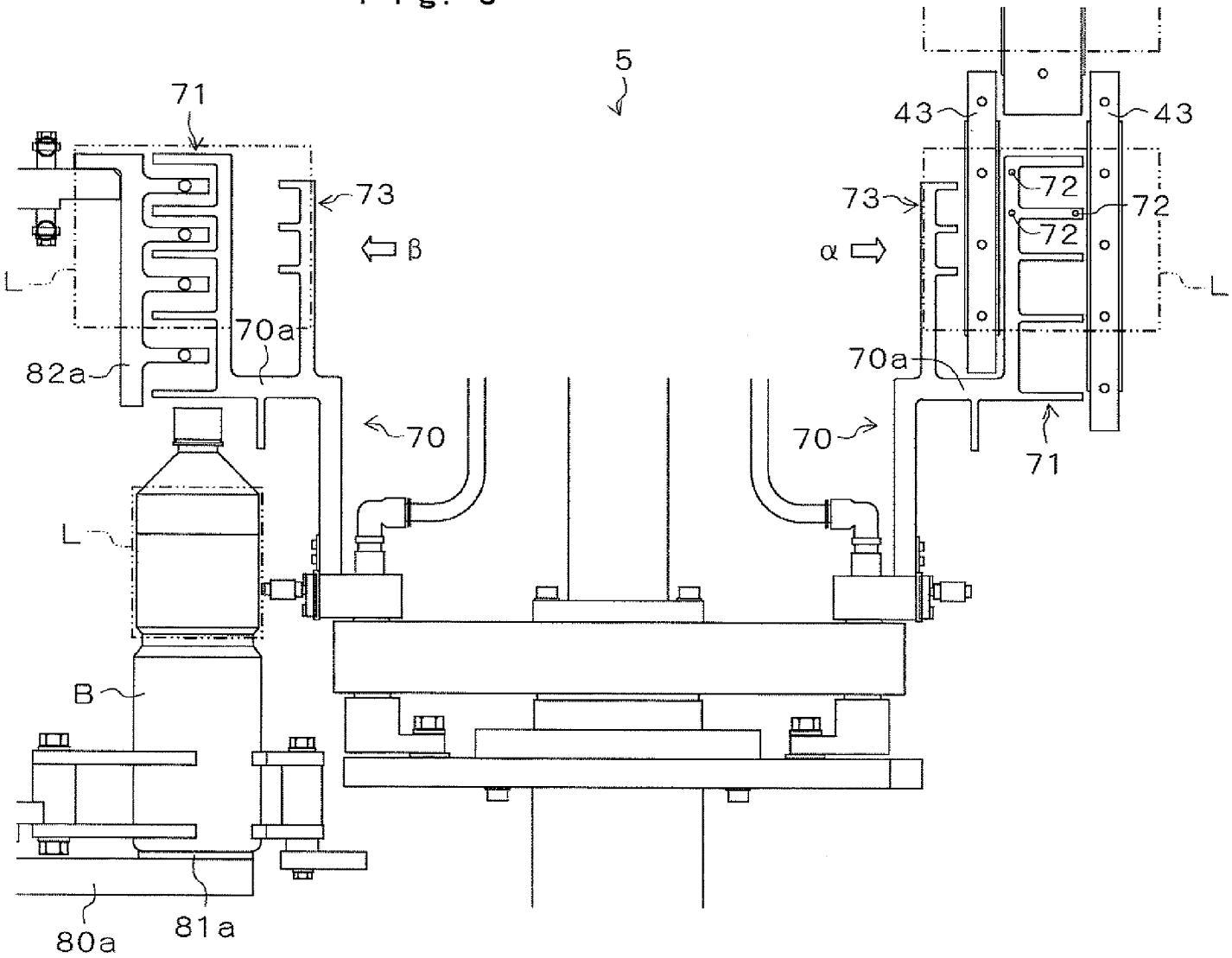
FIG. 3 is a schematic diagram showing a label delivery apparatus mounted to the label placement system.

As shown in FIGS. 1 through 3, the label delivery apparatus 5 includes a plurality of take-up members 70 that rotate so as to pass through the first label delivery position α and the second label delivery position β. Each take-up member 70 receives the label L supplied to the first label delivery position α so as to be sheet-like folded, and sends the label L to the label placement apparatus 6.

As shown in FIG. 3, the take-up member 70 includes: a pectinate holding section 71 that passes between a pair of feed belts 43, 43 of the label supplying apparatus 4 described later at the label delivery position α, and has suction holes 72 formed on its label supporting surface; and a pectinate assistance section 73 that passes outside one of the feed belts 43 (the one closer to the center of the rotation of the take up member 70). The holding section 71 and the assistance section 73 are connected to a common inverted L-shaped base arm 70*a*.

Therefore, when the take-up member 70, rotating at a constant rotational speed, passes through the first label delivery position α, the take-up member 70 receives the label L so as to hook the label L supplied so as to be held by suction by the pair of feed belts 43, 43. In the state where the take-up member 70 has received the label L, as shown in FIG. 3, the central portion of one side of the label L is supported, and at least the vicinity of the upper end of the label L is held by suction on the label supporting surface of the holding section 71, such that the upper edge of the label L is placed at the upper end of the holding section 71. If the label L is wide, one of the side portions of the label L (the one closer to the center of the rotation of the take-up member 70) that protrudes from the holding section 71 is supported by the assistance section 73.

As shown in FIGS. 1 and 2, the label placement apparatus 6 includes numerous label placement heads 80 attached at regular intervals in a concentric circle around a rotating shaft (not shown), via a plurality of support disks 80*a*, 80*b*, and 80*c* attached to the rotating shaft. Each label placement head 80 expands the sheet-like folded tubular label L received at the second label delivery position β, beyond the outer diameter of the bottle B, and places the expanded label L around the body of the bottle B while the bottle B received at the bottle supply position γ is conveyed to the bottle sending position δ.

As shown in FIG. 2, the label placement head 80 includes: bottle holding means 81 that holds the bottle B, received at the bottle supply position γ, such that the bottle B is mounted on a bottle holding stand 81*a*; a label opener 82 that opens the sheet-like folded label L received at the second label delivery position β, into a tube, and has a pair of openable and closable suction gripping arms 82*a*, to the ends of which pectinate gripping sections are attached that engage with the pectinate holding section 71 of the take-up member 70; label expansion means 83 that expands the tubular label L opened by the label opener 82, beyond the outer diameter of the bottle B; and label placement means 84 that places the label L expanded by the label expansion means 83 around the bottle B mounted on the bottle holding stand 81*a*. The sheet-like folded label L conveyed with its one side held by suction by the take-up member 70 of the label delivery apparatus 5 is, as shown in FIG. 3, received at the second label delivery position β by being gripped by the gripping sections of the pair of suction gripping arms 82*a*; subsequently, the label L is opened into a tube by opening the suction gripping arms 82*a* with the gripping sections holding the respective sides of the label L by suction, to separate both sides of the label L from each other, and is subsequently further expanded by the label expansion means 83; and while the bottle B received at the bottle supply position γ is conveyed to the bottle sending position δ so as to be held by the bottle holding stand 81*a*, the label L expanded beyond the outer diameter of the bottle B is placed around the body of the bottle B by the label placement means 84.

Figure 4:
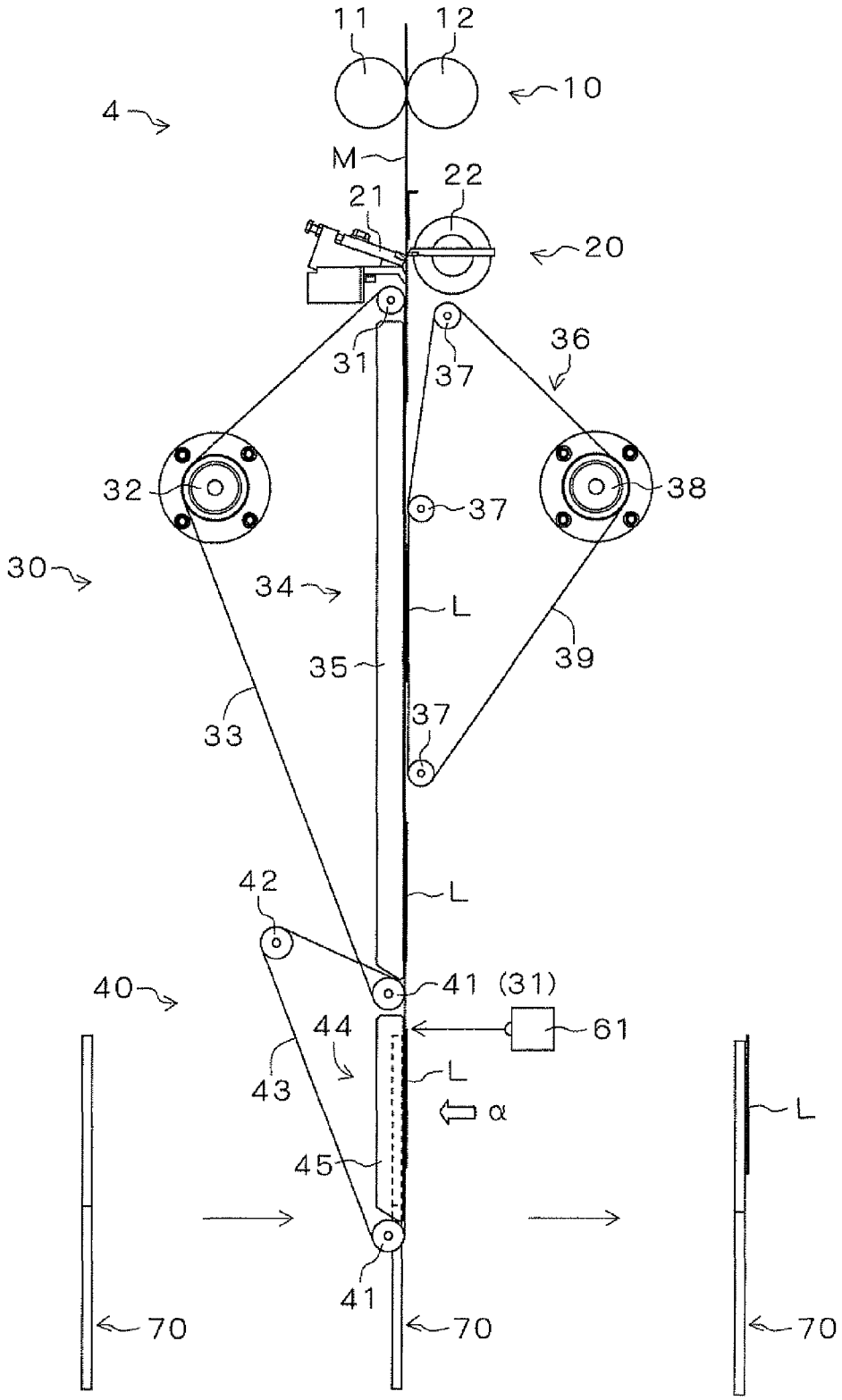
FIG. 4 is a schematic front view of the label supplying apparatus.
Figure 5:
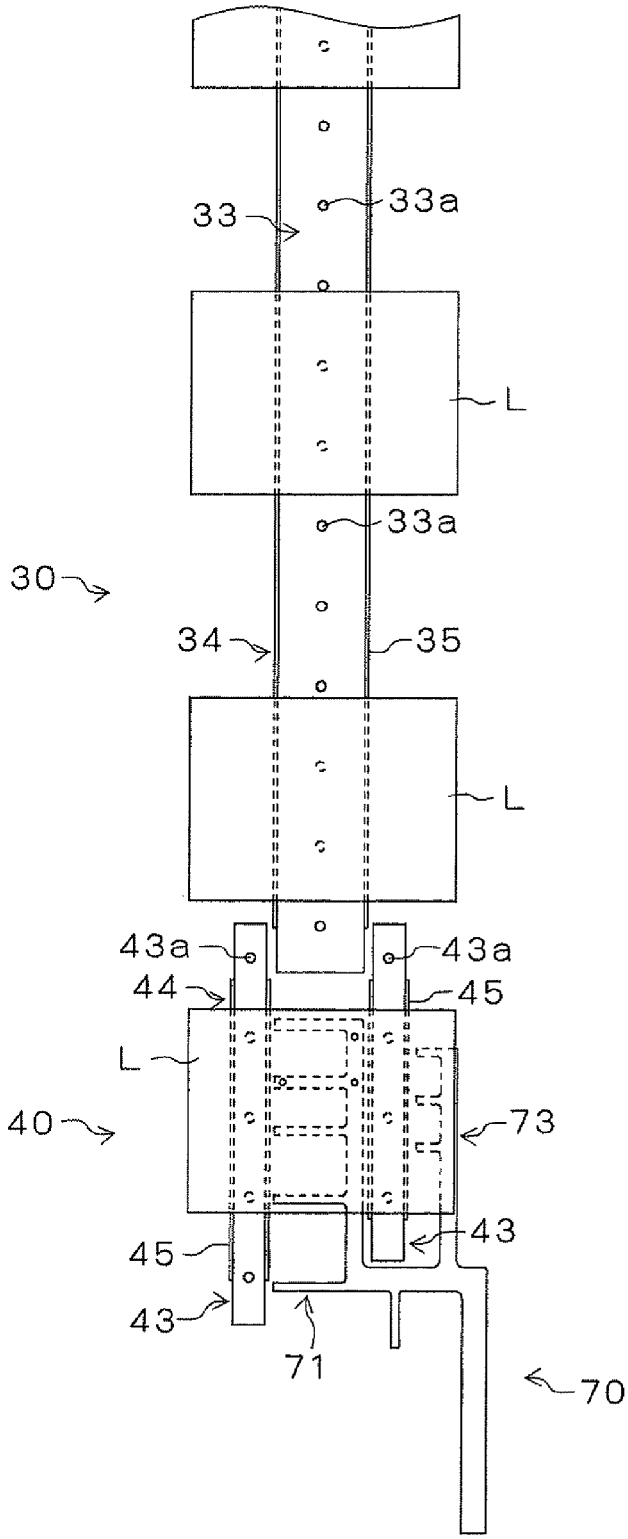
FIG. 5 is a partial schematic side view of the label supplying apparatus.
Figure 6:
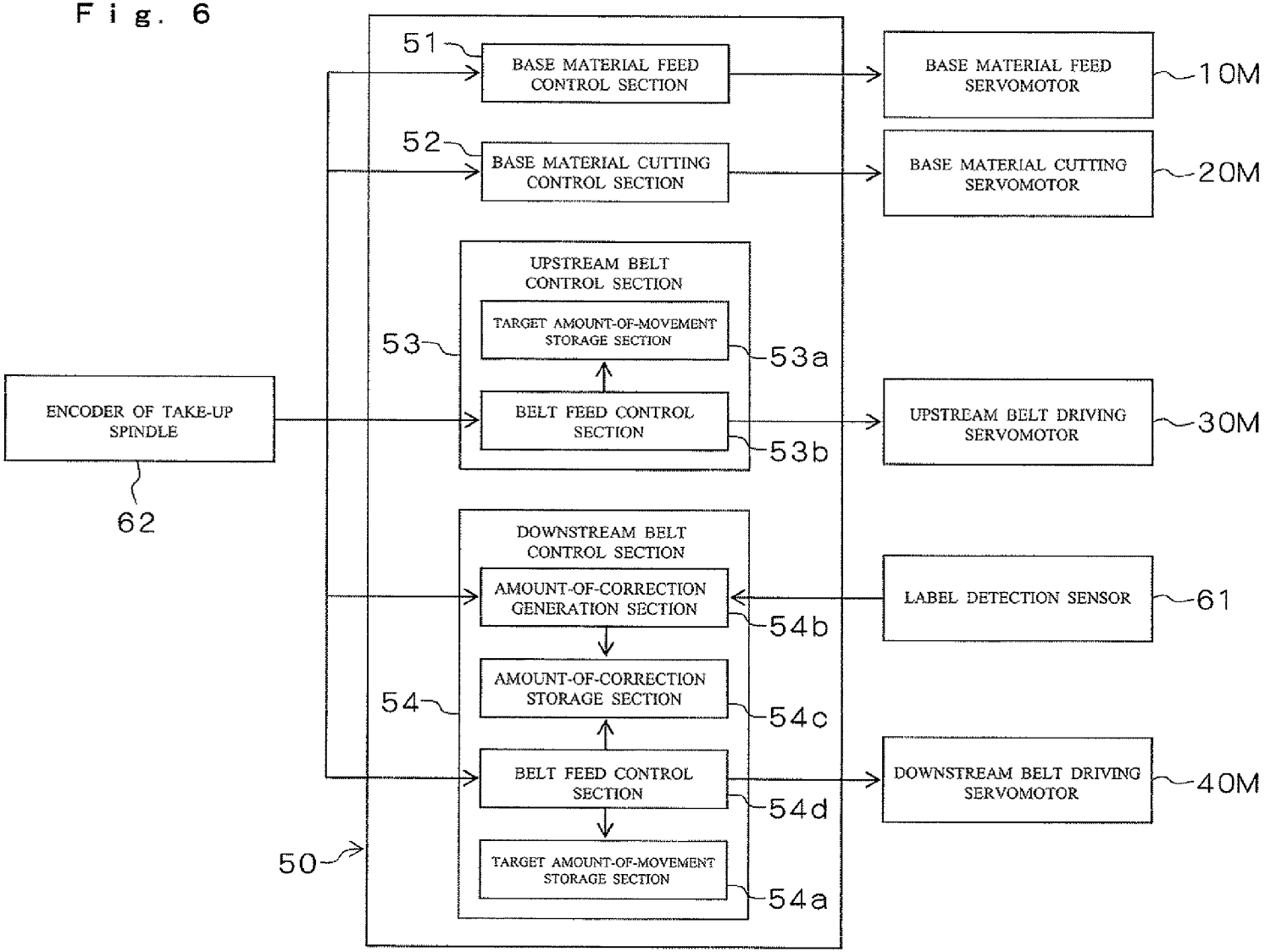
FIG. 6 is a functional block diagram showing a control unit of the label supplying apparatus.

As shown in FIG. 1 and FIGS. 3 through 6, the label supplying apparatus 4 includes: a label base material sending unit 10 that continuously sends the long label-forming base material M fed from the base material roll by the base material feed apparatus 3; a label base material cutting unit 20 that sequentially cuts, at predetermined cutting intervals, the label-forming base material M sent by the label base material sending unit 10; an upstream belt conveying unit 30 and a downstream belt conveying unit 40 that sequentially convey the label L formed as a result of the label base material cutting unit 20 cutting the label-forming base material M, to the label delivery position α; a label detection sensor 61 that detects the upper end of the label L delivered from the upstream belt conveying unit 30, at an upper position of the downstream belt conveying unit 40; an encoder 62 (see FIG. 6) attached to a take-up spindle of the label delivery apparatus 5; and a control unit 50 that controls the operations of the label base material sending unit 10, the label base material cutting unit 20, the upstream belt conveying unit 30, and the downstream belt conveying unit 40 on the basis of a label detection signal output from the label detection sensor 61 and a pulse signal output from the encoder 62 (see FIG. 6).

As shown in FIG. 4, the label base material sending unit 10 includes: a driving roller 11 that is driven by an independent base material feed servomotor 10M (see FIG. 6); and a driven roller 12 that sandwiches the sheet-like folded label-forming base material M between the driven roller 12 and the driving roller 11. The label-forming base material M sandwiched between both rollers 11 and 12 is sent by the rotation of the driving roller 11 to a base material cutting position below, where the label base material cutting unit 20 is provided.

As shown in FIG. 4, the label base material cutting unit 20 includes: a fixed blade 21 provided in a fixed manner at the base material cutting position; and a rotary blade 22 that is driven to rotate by an independent base material cutting servomotor 20M (see FIG. 6). Each time the rotary blade 22 rotates one revolution, the label-forming base material M continuously sent by the label base material sending unit 10 is sequentially cut to thereby sequentially form the label L having a predetermined length.

As shown in FIGS. 4 and 5, the upstream belt conveying unit 30 includes: a feed belt 33 that is passed over a driving pulley 32 and guide rollers 31 provided in the vicinity of the base material cutting position and at a position in the vicinity of the label delivery position α, respectively, and moves cyclically between the vicinity of the base material cutting position and the position in the vicinity of the label delivery position α at a speed faster than the speed of supplying the label-forming base material M; a suction mechanism 34 that causes the feed belt 33 to hold the label L by suction; and suction assistance means 36 that assists the suction mechanism 34 in the operation of the feed belt 33 holding the label L by suction, by bringing the label L into firm contact with the feed belt 33 sequentially from the lower end to the upper end of the label L. The driving pulley 32 is driven to rotate by an independent upstream belt driving servomotor 30M (see FIG. 6).

As shown in FIG. 5, the feed belt 33 is narrower than the label L to be conveyed, and has numerous suction holes 33*a* formed at a central portion in the width direction of the feed belt 33 at regular intervals along the longitudinal direction thereof, so as to hold the label L by suction at a central portion in the width direction of the label L.

As shown in FIGS. 4 and 5, the suction mechanism 34 includes: a suction chamber 35 placed along the feed belt 33 between the guide rollers 31; and a suction apparatus not shown in the figures, such as a vacuum pump connected to the suction chamber 35 through a tube or the like not shown in the figures. A suction opening is open on the surface of the suction chamber 35 that is in contact with the feed belt 33.

As shown in FIG. 4, the suction assistance means 36 is provided so as to oppose the feed belt 33 across the conveying line for the label L, and includes three guide rollers 37, a driving pulley 38, and a belt 39 passed over them. The driving pulley 38 is driven by the servomotor described above that moves the feed belt 33 cyclically. The rotational speed of the driving pulley 38 is set such that the belt 39 moves cyclically at the same speed as the moving speed of the feed belt 33.

The downstream belt conveying unit 40 includes: two feed belts 43, 43 that are passed over a driving pulley 42 and two guide rollers 41 provided one above the other across the label delivery position α, and move cyclically between above and below the label delivery position α; and a suction mechanism 44 that causes the feed belts 43, 43 to hold the label L by suction. The driving pulley 42 is driven to rotate by an independent downstream belt driving servomotor 40M.

As shown in FIG. 5, the feed belts 43, 43 are placed parallel to each other at a distance narrower than the width of the label L to be conveyed, and have numerous suction holes 43*a*, 43*a* formed at central portions in the width directions of the feed belts 43, 43 at regular intervals along the longitudinal directions thereof.

As shown in FIGS. 4 and 5, the suction mechanism 44 includes: a pair of left and right suction chambers 45, 45 placed along the respective feed belts 43, 43 between the guide rollers 41; and suction apparatuses not shown in the figures, such as vacuum pumps connected to the suction chambers 45, 45 through tubes or the like, respectively, not shown in the figures. Suction openings are open on the surfaces of the suction chambers 45, 45 that are in contact with the feed belts 43, 43, respectively.

As shown in FIG. 6, the control unit 50 includes a base material feed control section 51, a base material cutting control section 52, an upstream belt control section 53, and a downstream belt control section 54 that control the base material feed servomotor 10M, the base material cutting servomotor 20M, the upstream belt driving servomotor 30M, and the downstream belt driving servomotor 40M, respectively, on the basis of output pulses from the encoder 62 attached to the take-up spindle. The encoder 62 repeatedly outputs a pulse signal in a constant cycle in the following manner. As each take-up member 70 approaches the label delivery position α, the number of output pulses proportionally increases such that, on the assumption that all the take-up members 70 are attached with high accuracy so as not to cause attachment errors, the number of output pulses is 0 when one of the take-up members 70 passes through the label delivery position α, and the number of output pulses is 5000 when the next take-up member 70 passes through the label delivery position α; and when each take-up member 70 passes through the label delivery position α, the number of output pulses is reset to 0.

Figure 7:
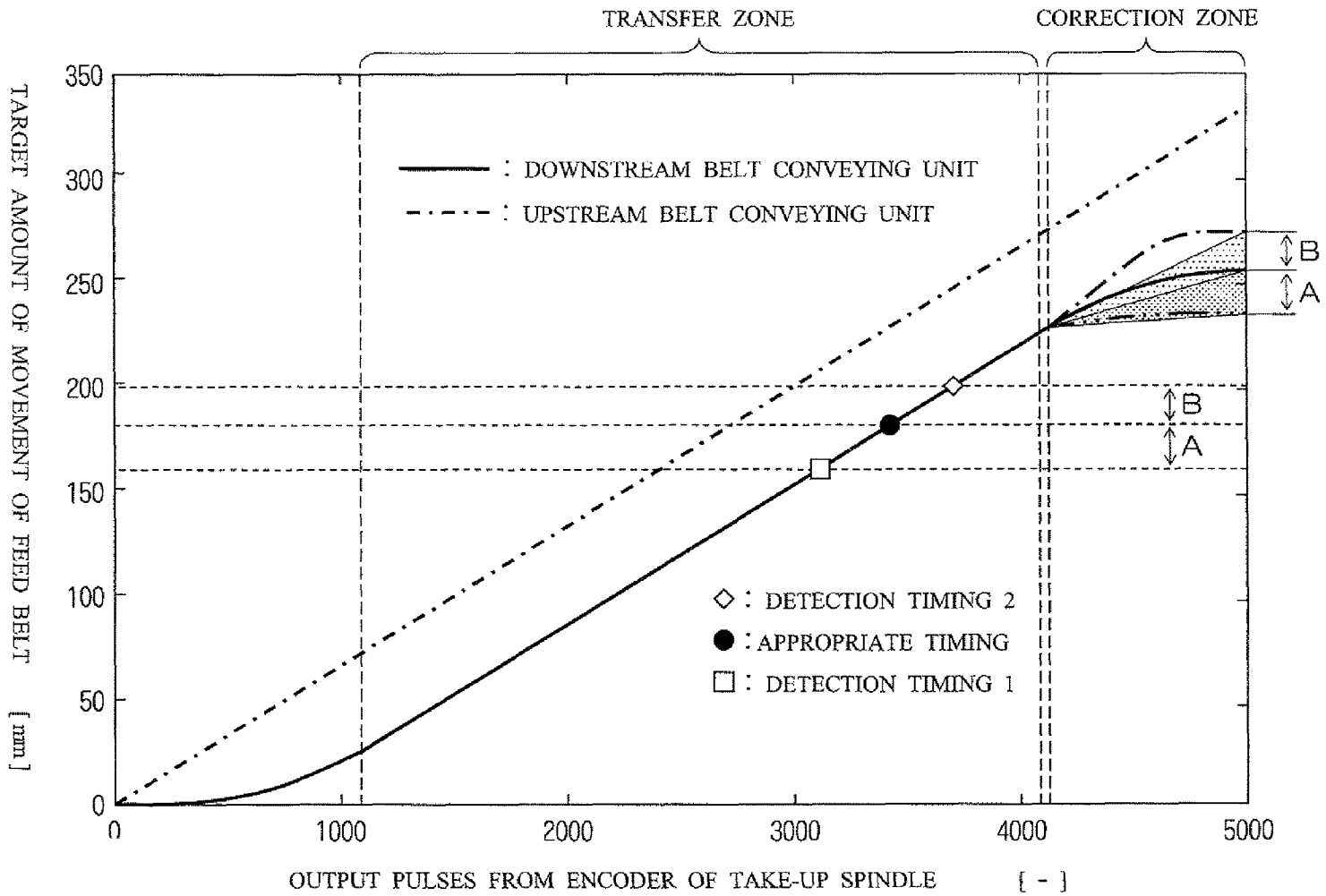
FIG. 7 is a graph showing the relationship between: target amounts of movement of feed belts of an upstream belt conveying unit and a downstream belt conveying unit that are mounted to the label supplying apparatus; and output pulses from an encoder of a take-up spindle.

The upstream belt control section 53 includes: a target amount-of-movement storage section 53*a* that, as shown by a short-dashed dotted line in the graph of FIG. 7, stores a target amount of movement set in advance in accordance with the number of output pulses from the encoder 62, that is, the position of the take-up member 70; and a belt feed control section 53*b* that controls the positioning of the upstream belt driving servomotor 30M so that the amount of movement of the feed belt 33 is the target amount of movement. The target amount of movement of the feed belt 33 is set such that the amount of change in the target amount of movement is always constant relative to the amount of movement of the take-up member 70.

The downstream belt control section 54 includes: a target amount-of-movement storage section 54*a* that, as shown by a solid line in the graph of FIG. 7, stores a target amount of movement of the feed belts 43 set in advance in accordance with the number of output pulses from the encoder 62, that is, the position of the take-up member 70; an amount-of-correction generation section 54*b* that, even when the label L formed as a result of the label base material cutting unit 20 cutting the label-forming base material M has shifted in position, for example, at the cutting of the label base material cutting unit 20, generates an amount of correction for correcting the target amount of movement of the feed belts 43 so that the label L is supplied to the label delivery position α at appropriate timing; an amount-of-correction storage section 54*c* that stores the amount of correction generated by the amount-of-correction generation section 54*b*; and a belt feed control section 54*d* that controls the positioning of the downstream belt driving servomotor 40M on the basis of the target amount of movement stored in the target amount-of-movement storage section 54*a* and the amount of correction stored in the amount-of-correction storage section 54*c*. As shown in FIG. 7, the amount-of-correction generation section 54*b* generates an amount of correction for correcting the target amount of movement of the feed belts 43 on the basis of the difference (hereinafter referred to as "amount of shift") (A and B shown in the graph of FIG. 7) between: the actual amount of movement of the feed belts 43 when the label detection sensor 61 has detected the upper end of the label L (for example, detection timing 1 and detection timing 2 shown in the graph of FIG. 7); and the target amount of movement of the feed belts 43 at the time of detecting the label when a shift does not occur in the label L (appropriate timing shown in the graph of FIG. 7).

As shown in FIG. 7, the target amount of movement of the feed belts 43 is different from the target amount of movement of the feed belt 33, which is proportional to the amount of movement of the take-up member 70. Before the label delivery position α, as the take-up member 70 approaches the label delivery position α, the amount of change in the target amount of movement of the feed belts 43 gradually decreases. Then, the take-up member 70 stops at the label delivery position α for about 4 msec. Subsequently, as the take-up member 70 separates from the label delivery position α, the amount of change in the target amount of movement of the feed belts 43 gradually increases and is fixed to the same amount of change as the amount of change in the target amount of movement of the feed belt 33.

Therefore, it is set such that the label L conveyed by the feed belt 33 of the upstream belt conveying unit 30 transfers to the feed belts 43 of the downstream belt conveying unit 40 in the zone where, as shown in FIG. 7, the amount of change in the target amount of movement of the feed belts 43 is fixed to the same amount of change as the amount of change in the target amount of movement of the feed belt 33, that is, in a transfer zone where the feed belts 43 and the feed belt 33 move at the same speed.

After the transfer zone described above has ended, the amount-of-correction generation section 54*b* generates an amount of correction in accordance with the position of the take-up member 70 in a correction zone set until the time corresponding to the label delivery position α, and, as shown by a dark shaded region and a light shaded region in the graph of FIG. 7, gradually corrects the amount of shift A or B described above in the correction zone. It should be noted that if the actual timing of detecting the label is earlier than the appropriate detection timing when a shift does not occur in the label L, the amount of correction is a negative value. On the other hand, if the actual timing of detecting the label is later than the appropriate detection timing, the amount of correction is a positive value.

The belt feed control section 54*d* basically controls the positioning of the downstream belt driving servomotor 40M so that the amount of movement of the feed belts 43 is the target amount of movement. In the correction zone, however, as shown by a long-dashed double-dotted line and a long-dashed dotted line in the graph of FIG. 7, the belt feed control section 54*d* controls the positioning of the downstream belt driving servomotor 40M so that the amount of movement of the feed belts 43 is a modified target amount of movement obtained by adding the amount of correction to the target amount of movement.

Figure 8:
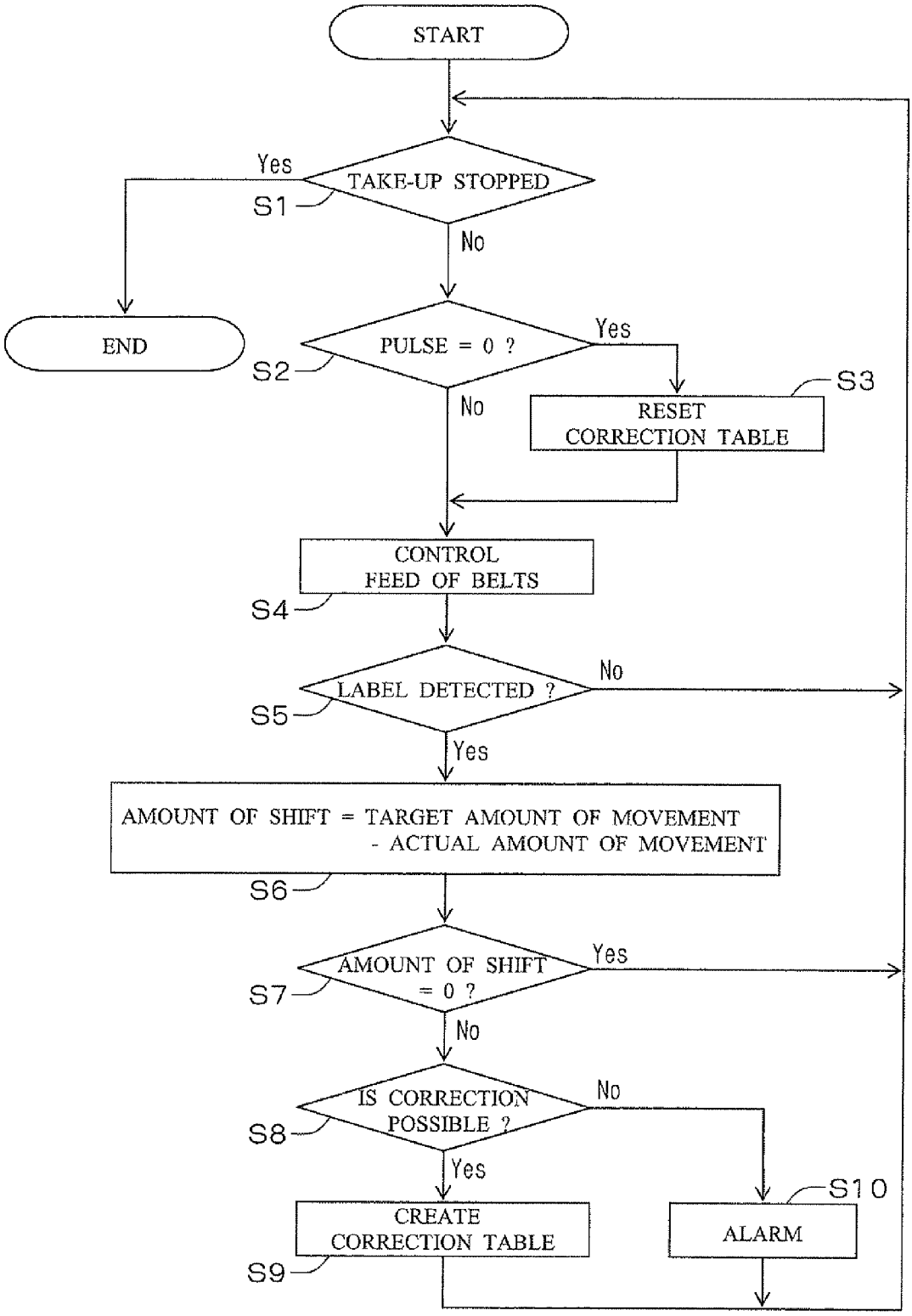
FIG. 8 is a flow chart showing a method of the control unit controlling the downstream belt conveying unit.
Figure 9:
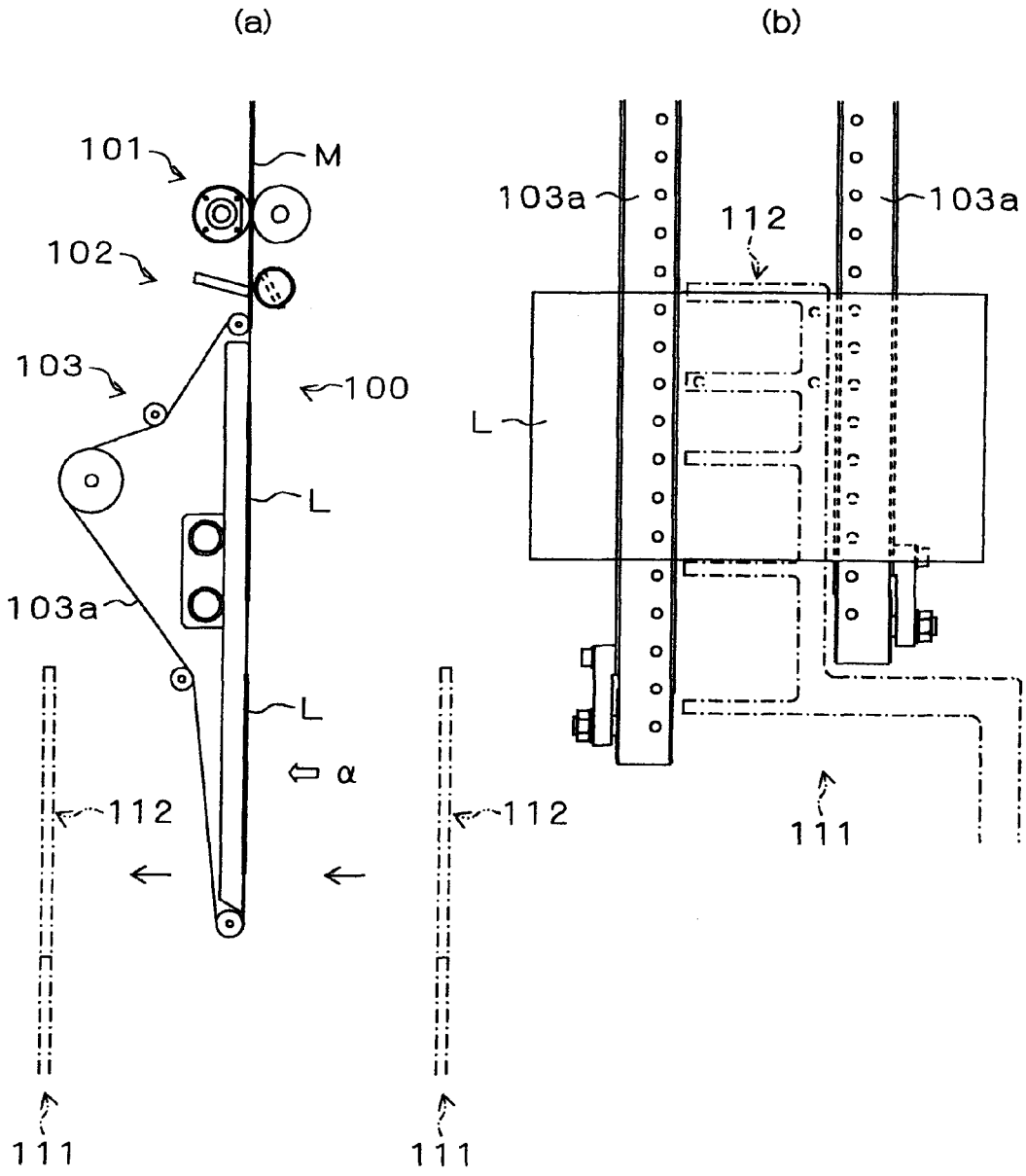
FIG. 9(*a*) is a front view of a conventional label supplying apparatus mounted to a label placement system.
Figure 10:
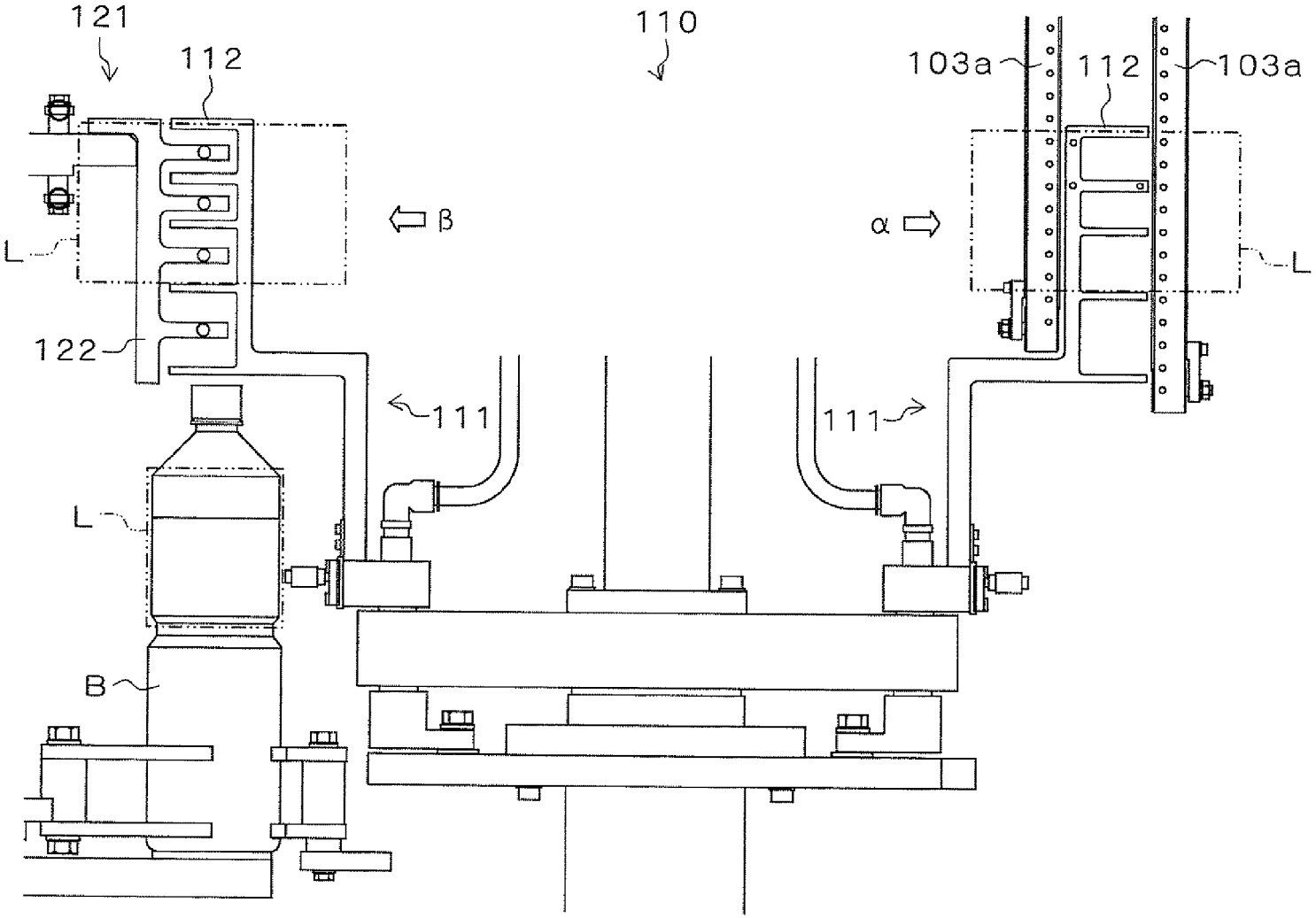
FIG. 10 is a schematic diagram showing a label delivery apparatus mounted to the label placement system.

With reference to a flow chart shown in FIG. 8, a description is given of a label conveying process performed by the downstream belt conveying unit 40 configured as described above. First, it is determined whether or not the take-up spindle is rotating (step S1). When the take-up spindle is not rotating, the label conveying process ends.

On the other hand, when the take-up spindle is rotating in step 91, the process proceeds to step S2, and it is determined whether or not the number of output pulses from the encoder 62 is "0", that is, whether or not the take-up member 70 is placed at the label delivery position α. When the number of output pulses is not "0", that is, when the take-up member 70 is not placed at the label delivery position α, the process proceeds to step 94, and the belt feed control section 54*d* controls the feed of the belts by controlling the positioning of the downstream belt driving servomotor 40M on the basis of the target amount of movement stored in the target amount-of-movement storage section 54*a* and the amount of correction stored in the amount-of-correction storage section 54*c* (step S4). On the other hand, when the number of output pulses is "0", that is, when the take-up member 70 is placed at the label delivery position α, the amount of correction stored in the amount-of-correction storage section 54*c* is reset to 0 (step S3), and subsequently, the belt feed control section 54*d* controls the feed of the belts (step S4).

Next, it is determined whether or not the label detection sensor 61 has detected the upper end of the label L (step S5). When the label detection sensor 61 has not detected the upper end of the label L, the process returns directly to step S1. On the other hand, when the label detection sensor 61 has detected the upper end of the label L, the amount-of-correction generation section 54*b* calculates, as the amount of shift, the difference between the actual amount of movement of the feed belts 43 at this time and the target amount of movement of the feed belts 43 at the time of detecting the label when a shift does not occur in the label L (step S6).

Next, it is determined whether or not the calculated amount of shift is 0 (step S7). When the amount of shift is 0, a shift has not occurred in the position of the label L, and therefore, the process returns directly to step S1. On the other hand, when the amount of shift is not 0, a shift has occurred in the position of the label L, and therefore, it is determined whether or not it is possible to make a correction, that is, whether or not the amount of shift is greater than 5 mm (step S8).

When the amount of shift is greater than 5 mm in step S8, it is not possible to make a correction. Thus, notification is made to this effect by an alarm (step S10), and subsequently, the process returns to step S1. On the other hand, when the amount of shift is equal to or less than 5 mm, it is possible to make a correction. Thus, the amount-of-correction generation section 54*b* generates an amount of correction for correcting the target amount of movement of the feed belts 43, and stores the generated amount of correction in the amount-of-correction storage section 54*c* (step S9). Subsequently, the process returns to step S1, and the same process is repeatedly performed until the take-up spindle stops.

As described above, in the label supplying apparatus 4, the label L formed as a result of the label base material cutting unit 20 cutting the label-forming base material M is conveyed by the upstream belt conveying unit 30 and the downstream belt conveying unit 40. When it is detected that a shift has occurred in the position where the feed belts 43 of the downstream belt conveying unit 40 hold the label L by suction, the target amount of movement of the feed belts 43 after the label L has completely transferred from the feed belt 33 of the upstream belt conveying unit 30 to the feed belts 43 of the downstream belt conveying unit 40 is corrected, so that the downstream belt conveying unit 40 conveys the label L while modifying a shift in the timing of supplying the label L caused by the shift in the label L. Thus, even when a shift has occurred in the position where the feed belts 43 hold the label L by suction, it is possible to supply the label L to the label delivery position α in accordance with the timing of the take-up member 70 receiving the label L.

In addition, in the label supplying apparatus 4, the downstream belt conveying unit 40 stops the label L at the label delivery position α. Thus, even when the timing of the take-up member 70 receiving the label L has shifted somewhat due to a low attachment accuracy of the take-up member 70, it is possible to ignore the effect of the shift. This enables the take-up member 70 to receive the label L in an appropriate manner.

It should be noted that in the embodiment described above, the downstream belt conveying unit 40 stops the label L at the label delivery position α to thereby absorb a shift in the timing of the take-up member 70 receiving the label L caused by a decrease in the attachment accuracy of the take-up member 70. The present invention, however, is not limited to this. For example, it is also possible to obtain a similar effect by causing the label L to enter the label delivery position α at a low speed.

Further, in the embodiments described above, to absorb a shift in the timing of the take-up member 70 receiving the label L caused by a reduction in the attachment accuracy of the take-up member 70, the downstream belt conveying unit 40 stops the label L at the label delivery position α, or causes the label L to enter the label delivery position α at a low speed. The present invention, however, is not limited to this. For example, it is possible to provide a take-up member detection sensor that detects, at a predetermined reference position, the holding section 71 that actually holds the label L by suction in the take-up member 70. Then, it is possible to calculate, as the amount of shift in the timing of the take-up member 70 receiving the label L at the label delivery position α, the difference between: a pulse signal actually output from the encoder 62 when the take-up member detection sensor has detected the holding section 71 of the take-up member 70; and an appropriate pulse signal output from the encoder 62 when the take-up member 70 passes through the reference position on the assumption that all the take-up members 70 are attached with high accuracy so as not to cause attachment errors. Then, the amount-of-correction generation section 54*b* can generate an amount of correction for modifying a shift in the position of the label L, taking into account the amount of shift in the timing of the take-up member 70 receiving the label L. In this case, to absorb the shift in the timing of the take-up member 70 receiving the label L, the downstream belt conveying unit 40 does not need to stop the label L at the label delivery position α, or does not need to cause the label L to enter the label delivery position α at a low speed. Alternatively, the downstream belt conveying unit 40 can cause the label L to enter the label delivery position α at a conveying speed close to the speed of the upstream belt conveying unit 30 conveying the label L. Thus, the present invention is suitable for a high-speed operation.

INDUSTRIAL APPLICABILITY

In the embodiments described above, the description is given of the label supplying apparatus 4 mounted to the label placement system 1 for the placing tubular label L around the body of the bottle B. The present invention, however, is not limited to this, and can be applied to various film processing systems that need to supply a sheet film to a predetermined position at predetermined timing.

DESCRIPTION OF THE REFERENCE CHARACTERS

1 label placement system
2 bottle supplying apparatus
3 base material feed apparatus
4 label supplying apparatus (film supplying apparatus)
5 label delivery apparatus
6 label placement apparatus (film processing apparatus)
7 bottle conveying apparatus
8 belt conveyor
10 label base material sending unit
10M base material feed servomotor
11 driving roller
12 driven roller
20 label base material cutting unit
20M base material cutting servomotor
21 fixed blade
22 rotary blade
30 upstream belt conveying unit
30M upstream belt driving servomotor
31 guide roller
32 driving pulley
33 feed belt
33*a* suction hole
34 suction mechanism
35 suction chamber
36 suction assistance means
37 guide roller
38 driving pulley
39 belt
40 downstream belt conveying unit
40M downstream belt driving servomotor
41 guide roller
42 driving pulley
43 feed belt
43*a* suction hole
44 suction mechanism
45 suction chamber
50 control unit
51 base material feed control section
52 base material cutting control section
53 upstream belt control section
53*a* target amount-of-movement storage section
53*b* belt feed control section
54 downstream belt control section
54*a* target amount-of-movement storage section
54*b* amount-of-correction generation section
54*c* amount-of-correction storage section
54*d* belt feed control section
61 label detection sensor (film detection means)
62 encoder
70 take-up member (film delivery member)
71 holding section
72 suction hole
73 assistance section
80 label placement head
81 bottle holding means
82 label opener
82*a* suction gripping arm
83 label expansion means

84 label placement means
B PET bottle
L shrink label (film)

The invention claimed is:

1. A film supplying apparatus for supplying a film to a predetermined film delivery position in accordance with timing of a film delivery member receiving the film, the film delivery member receiving the film when passing through the film delivery position and delivering the film to a film processing apparatus, the film supplying apparatus comprising:

an upstream belt conveying unit for conveying the film with a feed belt holding the film by suction, the upstream belt conveying unit driven by a servomotor;

a downstream belt conveying unit for conveying the film that has been conveyed by the upstream belt conveying unit, to the film delivery position with feed belts holding the film by suction, the downstream belt conveying unit driven by a servomotor;

a film detector for detecting the film that is being conveyed at a predetermined reference position; and a control unit for controlling operations of the upstream belt conveying unit and the downstream belt conveying unit, wherein a target amount of movement of the feed belt of the upstream belt conveying unit and a target amount of movement of the feed belts of the downstream belt conveying unit are set in advance in accordance with a position of the film delivery member, so that the film stops at, or enters at a low speed, the film delivery position when the film delivery member passes through the film delivery position, the control unit controls positioning of the servomotor so as to obtain the target amount of movement of the feed belt of the upstream belt conveying unit set in advance, and also controls positioning of the servomotor so as to obtain the target amount of movement of the feed belts of the downstream belt conveying unit set in advance, and if an actual amount of movement of the feed belts when the film defector has detected the film is different from the target amount of movement of the feed belts, it is determined that a shift has occurred in a position where the feed belts hold the film by suction, and the target amount of movement of the feed belts of the downstream belt conveying unit after the film has completely transferred to the feed belts of the downstream belt conveying unit is corrected on the basis of an amount of shift between the actual amount of movement of the feed belts and the target amount of movement thereof, so that the film is conveyed while a shift in timing of supplying the film caused by a shift in the film is modified.

2. A film supplying apparatus for supplying a film to a predetermined film delivery position in accordance with timing of a film delivery member receiving the film, the film delivery member receiving the film when passing through the film delivery position and delivering the film to a film processing apparatus, the film supplying apparatus comprising:

an upstream belt conveying unit for conveying the film with a feed belt holding the film by suction, the upstream belt conveying unit driven by a servomotor;

a downstream belt conveying unit for conveying the film that has been conveyed by the upstream belt conveying unit, to the film delivery position with feed belts holding the film by suction, the downstream belt conveying unit driven by a servomotor;

a film detector for detecting the film that is being conveyed at a predetermined reference position;

a delivery member detector for detecting the film delivery member at a predetermined reference position; and a control unit for controlling operations of the upstream belt conveying unit and the downstream belt conveying unit, wherein a target amount of movement of the feed belt of the upstream belt conveying unit and a target amount of movement of the feed belts of the downstream belt conveying unit are set in advance in accordance with a position of the film delivery member, so that the film is placed at the film delivery position when the film delivery member passes through the film delivery position, the control unit controls positioning of the servomotor so as to obtain the target amount of movement of the feed belt of the upstream belt conveying unit set in advance, and also controls positioning of the servomotor so as to obtain the target amount of movement of the feed belts of the downstream belt conveying unit set in advance, if an actual amount of movement of the feed belts when the film detector has detected the film is different from the target amount of movement of the feed belts, it is determined that a shift has occurred in a position where the feed belts hold the film by suction, and if timing of the delivery member detector detecting the film delivery member is shifted from original appropriate timing, it is determined that a shift will occur in the timing of the film delivery member receiving the film, and the target amount of movement of the feed belts of the downstream belt conveying unit after the film has completely transferred to the feed belts of the downstream belt conveying unit is corrected on the basis of an amount of shift between the actual amount of movement of the feed belts and the target amount of movement thereof and an amount of shift between the timing of detecting the film delivery member and the appropriate timing, so that the film is conveyed while a shift in timing of supplying the film caused by a shift in the film is modified, taking into account the shift in the timing of the film delivery member receiving the film.

3. A film supplying method for supplying a film to a predetermined film delivery position in accordance with timing of a film delivery member receiving the film, the film delivery member receiving the film when passing through the film delivery position and delivering the film to a film processing apparatus, wherein the film that has been conveyed with a feed belt of an upstream belt conveying unit holding the film by suction is conveyed to the film delivery position with feed belts of a downstream belt conveying unit holding the film by suction, the upstream belt conveying unit driven by a servomotor and the downstream belt conveying unit driven by a servomotor, a target amount of movement of the feed belt of the upstream belt conveying unit and a target amount of movement of the feed belts of the downstream belt conveying unit are set in advance in accordance with a position of the film delivery member, so that the film stops at, or enters at a low speed, the film delivery position when the film delivery member passes through the film delivery position, positioning of the servomotor is controlled so as to obtain the target amount of movement of the feed belt of the upstream belt conveying unit set in advance, and positioning of the servomotor is also controlled so as to obtain the target amount of movement of the feed belts of the downstream belt conveying unit set in advance, and if an actual amount of movement of the feed belts when the film has been detected at a predetermined reference position is different from the target amount of movement of the feed belts, it is determined that a shift has occurred in a position where the feed belts hold the film by suction, and the target amount of movement of the feed belts of the downstream belt conveying unit after the film has completely transferred to the feed belts of the downstream belt conveying unit is corrected on the basis of an amount of shift between the actual amount of movement of the feed belts and the target amount of movement thereof, so that the film is conveyed while a shift in timing of supplying the film caused by a shift in the film is modified.

4. A film supplying method for supplying a film to a predetermined film delivery position in accordance with timing of a film delivery member receiving the film, the film delivery member receiving the film when passing through the film delivery position and delivering the film to a film processing apparatus, wherein the film that has been conveyed with a feed belt of an upstream belt conveying unit holding the film by suction is conveyed to the film delivery position with feed belts of a downstream belt conveying unit holding the film by suction, the upstream belt conveying unit driven by a servomotor and the downstream belt conveying unit driven by a servomotor, a target amount of movement of the feed belt of the upstream belt conveying unit and a target amount of movement of the feed belts of the downstream belt conveying unit are set in advance in accordance with a position of the film delivery member, so that the film is placed at the film delivery position when the film delivery member passes through the film delivery position, positioning of the servomotor is controlled so as to obtain the target amount of movement of the feed belt of the upstream belt conveying unit set in advance, and positioning of the servomotor is also controlled so as to obtain the target amount of movement of the feed belts of the downstream belt conveying unit set in advance, if an actual amount of movement of the feed belts when the film has been detected at a predetermined reference position is different from the target amount of movement of the feed belts, it is determined that a shift has occurred in a position where the feed belts hold the film by suction, and if timing of the film delivery member being detected at a predetermined reference position is shifted from original appropriate timing, it is determined that a shift will occur in the timing of the film delivery member receiving the film, and the target amount of movement of the feed belts of the downstream belt conveying unit after the film has completely transferred to the feed belts of the downstream belt conveying unit is corrected on the basis of an amount of shift between the actual amount of movement of the feed belts and the target amount of movement thereof and an amount of shift between the timing of detecting the film delivery member and the appropriate timing, so that the film is conveyed while a shift in timing of supplying the film caused by a shift in the film is modified, taking into account the shift in the timing of the film delivery member receiving the film.

* * * * *